United States Patent [19]

Irimajiri et al.

[11] Patent Number: 4,466,400

[45] Date of Patent: Aug. 21, 1984

[54] INTERNAL COMBUSTION ENGINE

[75] Inventors: Shoichiro Irimajiri, Saitama; Shoichi Honda, Tokyo, both of Japan

[73] Assignee: Honda Giken Kogyo Kabushiki Kaisha, Tokyo, Japan

[21] Appl. No.: 451,848

[22] Filed: Dec. 21, 1982

Related U.S. Application Data

[63] Continuation-in-part of Ser. No. 175,390, Aug. 5, 1980, abandoned.

[30] Foreign Application Priority Data

Aug. 7, 1979 [JP] Japan ..... 54-100467

[51] Int. Cl.[3] ..... F02F 3/28

[52] U.S. Cl. ..... 123/193 P; 92/177

[58] Field of Search ..... 123/193 R, 193 P, 90.27; 92/177

[56] References Cited

U.S. PATENT DOCUMENTS

| | | | |
|---|---|---|---|
| 2,257,417 | 9/1941 | Kelley | 123/193 P |
| 2,409,555 | 10/1946 | Gadoux et al. | 92/177 |
| 3,090,368 | 5/1963 | Buchwald | 123/90.27 |
| 3,441,012 | 4/1969 | Trammell, Jr. | 123/193 P |
| 3,722,484 | 3/1973 | Gordini | 123/90.27 |
| 4,177,772 | 12/1979 | Franke | 123/75 B |
| 4,256,068 | 5/1981 | Irimajiri et al. | 123/193 P |
| 4,350,126 | 9/1982 | Honda | 123/193 M |

FOREIGN PATENT DOCUMENTS 469883 8/1937 United Kingdom .

*Primary Examiner*—Craig R. Feinberg
*Attorney, Agent, or Firm*—Lyon & Lyon

[57] ABSTRACT

A piston and cylinder are oblong in cross section with the major dimension at right angles to the crankshaft axis. An inlet valve and an exhaust valve are mounted near opposed end portions of the oblong cylinder with a spark plug arranged along the minor centerline, either between the valve or displaced laterally from the major centerline of the cylinder. The valves are symmetrically inclined with respect to the central axis of the oblong cylinder, and are operated from separate camshafts. The combustion chamber roof is a concave surface having both major and minor centerline surface elements which employ radii of curvature greater than the radius of curvature of the cross-sectional ends of the oblong cylinder.

8 Claims, 6 Drawing Figures

INTERNAL COMBUSTION ENGINE

CROSS-REFERENCE TO RELATED APPLICATION

This is a continuation-in-part of U.S. patent application Ser. No. 175,390, filed August 5, 1980, now abondoned.

BACKGROUND OF THE INVENTION

The field of the present invention is four-cycle internal combustion engines having cylinders oblong in cross section.

Generally, in order to obtain high performance in a four-cycle engine, several, sometimes competing, conditions must be satisfied or maximized: (1) The head area of the intake valve or valves and of the exhaust valve or valves is preferably as large as possible in relation to the cross-sectional area of the cylinder bore; (2) The combustion chamber is preferably as compact as possible so that a large portion of the air-fuel mixture is gathered in the vicinity of the spark plug; (3) The spark plug is preferably located to minimize the longest distance from the spark plug to the edge of the combustion chamber as well as have the spark plug as near as possible the majority of the air-fuel mixture; (4) The surface to volume ratio of the combustion chamber is preferably minimized; (5) The compression ratio is preferably fairly high; (6) The chamber configuration is preferably correct for proper mixture flow for intake and exhaust efficiency and for effective mixture distribution. In conventional engines of such construction, the cylinder bore and the piston are circular in cross section so that there is a limit in concurrently satisfying each of the above-stated conditions. If the engine constitutes a multi-valve type by providing two or more intake valves and two or more exhaust valves for each cylinder, for instance, and positioning a spark plug at the center thereof, this arrangement is very advantageous in satisfying certain of the above-stated conditions. However, with an increase in the number of intake valves and exhaust valves, the valve-operating mechanism necessarily becomes complicated, resulting in cost increases which make impractical the adoption of such designs for engines manufactured on a quantity production basis.

SUMMARY OF THE INVENTION

In view of the foregoing, the present invention has the object of providing a four-cycle engine which enables the above-stated conditions to be more fully satisfied. This is accomplished without the need for added complexity, by providing a single intake valve and a single exhaust valve for each of any number of oblong cylinders. Thereby, simplified construction and high performance can be achieved.

Each piston and cylinder are made oblong in cross section with the major cross-sectional dimension at right angles to the crank shaft axis. The term "oblong" refers to a cross section which is "oval" or "eliptical" or elongated circular shape with straight sides and semicircular ends, or to any cross section in which the length and breadth are not equal. The orientation of the cylinders relative to the crank thus allows a smaller cylinder bank envelop and the use of two overhead camshafts per bank, one intake and one exhaust.

A single poppet type inlet valve communicates with each combustion chamber and is positioned near one end of the oblong cylinder. A single poppet type exhaust valve also communicates with each combustion chamber and is positioned near the other end of the oblong cylinder. For sake of clarity, the areas most adjacent the wall portions of each cylinder having minimum radii of curvature will be referred to as the ends of the cylinder which the area most adjacent the cylinder head will be referred to as the top of the cylinder. The valves each have a longitudinal axis symmetrically inclined with respect to the central axis of the cylinder, and a spark plug is positioned centrally in the chamber, either on the central axis or displaced from the major axis and on the minor axis for enhanced valve placement.

The combustion chamber is configured for maximum realization of the listed conditions. The major and minor centerline elements of the combustion chamber roof are formed about fixed radii of curvature to minimize the surface to volume ratio in one aspect of the present invention. The piston is domed in another aspect of the present invention for similar considerations.

A radius of curvature which is substantially larger than one half the width of the cylinder is employed in yet another aspect of the present invention while the domed piston is also used. When such an arrangement is employed, combination chamber squish is experienced where a higher ratio of compression is experienced at the periphery of the combustion chamber. This results in turbulence and a general movement of the mixture inwardly toward the center of the chamber with upward movement of the piston.

The employment of large pistons in an oblong arrangement can result in a restriction of the flow around one half of the periphery of the valve head, that portion most adjacent the proximal end of the cylinder. In conventional cylinders which are circular in cross section, the substantial disparity in the radii of curvature of the periphery of the valves and the side of the cylinder avoids such restriction except at the small arc of greatest proximity. In accordance with the present invention, the large valves may be moved away from the ends of the oblong cylinder to better promote flow to and scavenging from the extreme areas of the cylinders. This is particularly true with the side placement of the spark plug.

Other objects and advantages will appear hereinafter.

IN THE DRAWINGS

Figure 1:
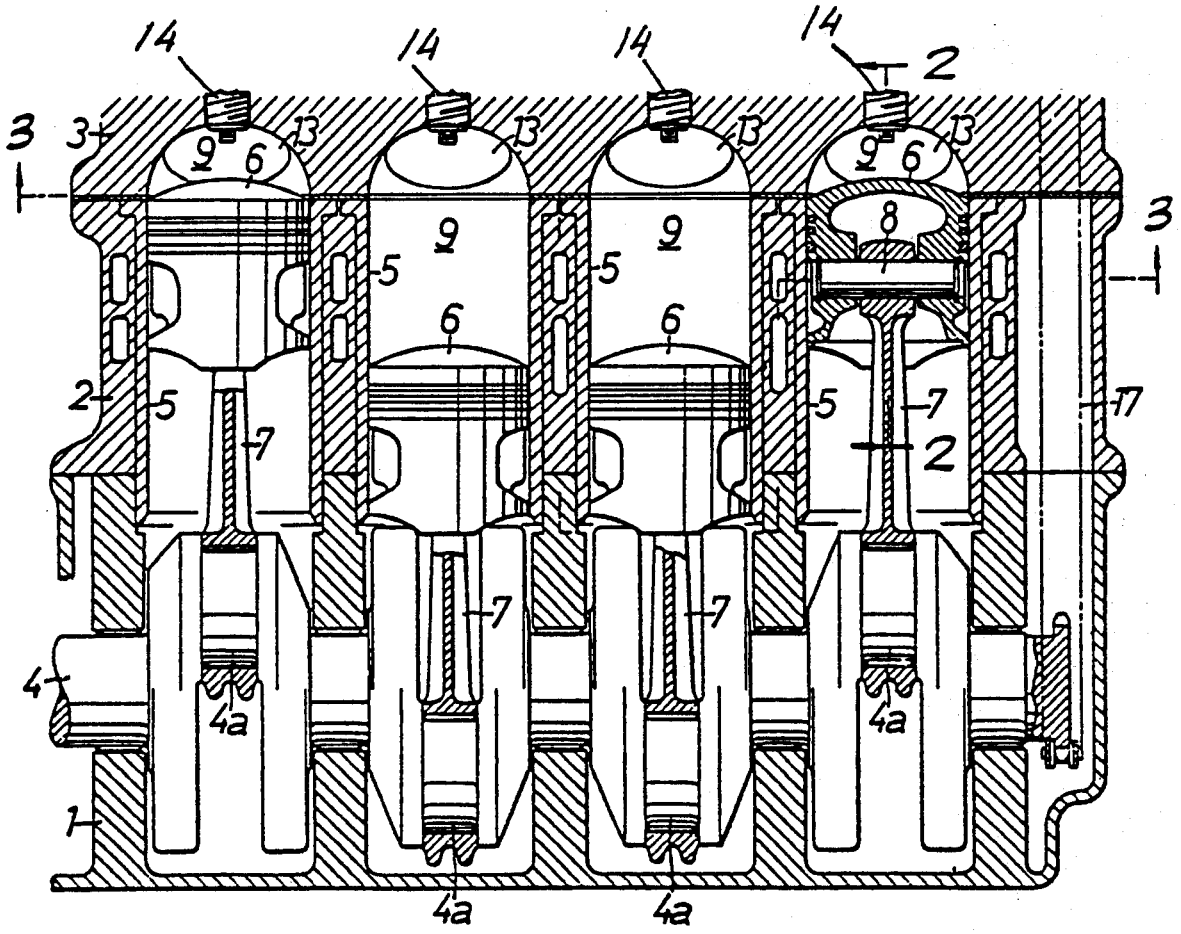
FIG. 1 is a longitudinal sectional view of a preferred embodiment of this invention.
Figure 2:
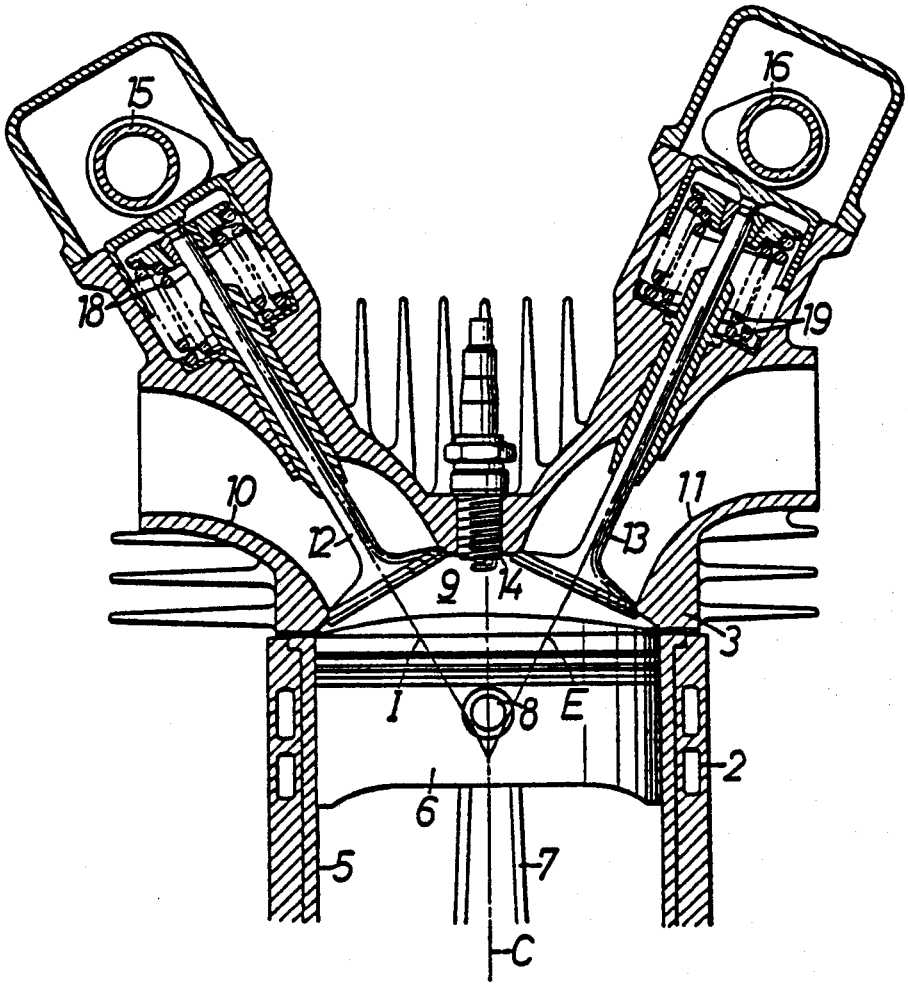
FIG. 2 is a transverse sectional view taken substantially on the lines 2—2 as shown on FIG. 1.
Figure 3:
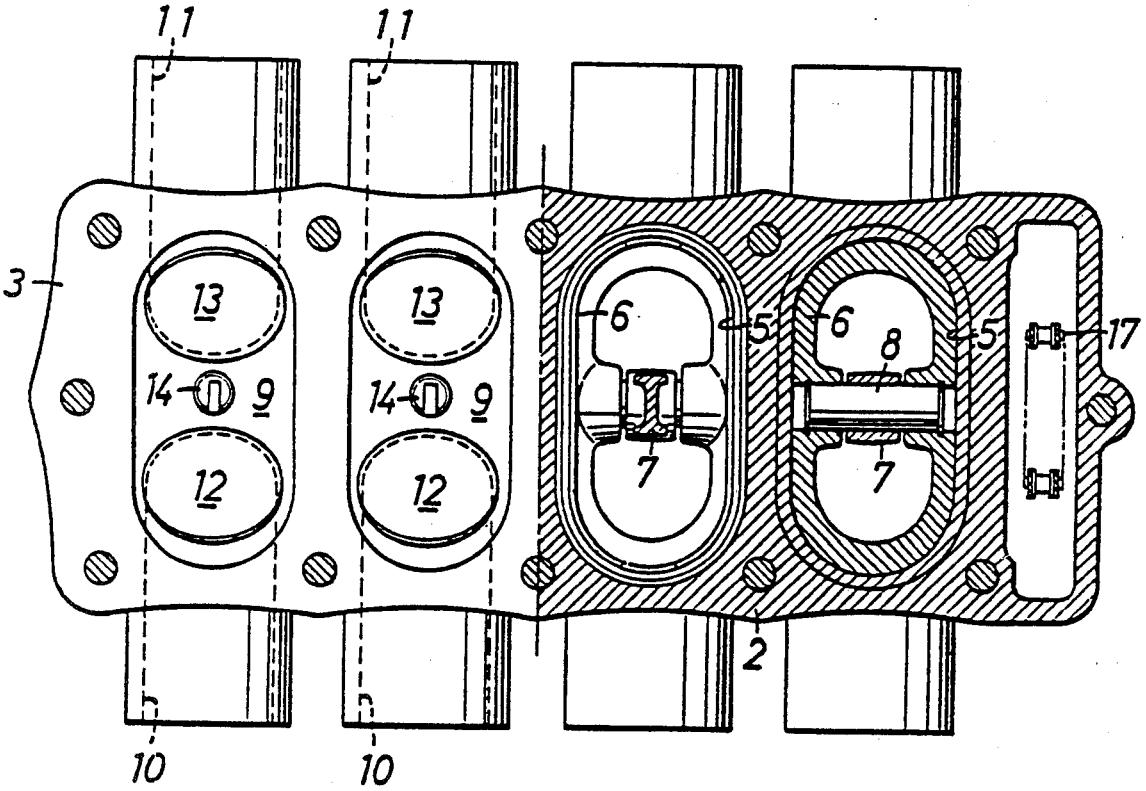
FIG. 3 is a plan view, partly in section taken substantially on the lines 3—3 as shown on FIG. 1.

Referring to FIGS. 1-3, the internal combustion engine is provided with a crankcase 1, a cylinder block 2 and a cylinder head 3. A crankshaft 4 is mounted to rotate in the crankcase 1 and is provided with the usual crankpins 4*a*. Each of the cylinder bores 5 receives a sliding piston 6 and each piston 6 is connected to one of the crankpins 4a by means of a connecting rod 7 and piston pin 8.

The cylinder bores 5 are not circular, but on the contrary are oblong in a direction at right angles to the axis of the crankshaft 4. The four cylinder bores 5 as shown are disposed in-line in the direction of the minor axes of their cross sections. The pistons 6 have substantially the same oblong shape as the cylinder bores 5. The upper surface of the domed pistons 6 cooperate with concave spaces in the cylinder head 3 and the cylinders 5 to form combustion chambers 9. Intake passages 10 and discharge passages 11 are closed by intake valves 12 and exhaust valves 13, respectively. These valves are of the poppet type. In the embodiment shown, the cylinders are formed by two semi-cylindrical sections at either end of the cylinder. Flat planar sections join these semi-cylindrical sections. Thus, there are two end wall segments of minimum radii of curvature and two opposed sidewall segments joining the end wall segments.

The combustion chambers 9 are arranged for maximum efficiency. As a sphere provides the least surface area to volume ratio, the configuration of the combustion chamber 9 has taken from this shape. The centerline element of the concave surface of the cylinder head 3 associated with each cylinder 5 has a substantially constant radius of curvature, emulating where possible a sphere. This radius of curvature is substantially larger than the radius of curvature of the cylinder surface at its ends. Thus, true spherical surfaces at either end of the oblong shape are not created. The actual radius employed is highly dependent upon such considerations as the shape of the piston surface and the desired compression ratio. However, in a preferred embodiment contemplated by the present invention, the radius of curvature of the centerline element of the concave surface of the cylinder head 3 is more than twice as large as the radius of curvature of the end wall of the oblong cylinder 5.

Considering the concave surface of the cylinder head 3 from the direction of the minor cross-sectional dimension of the cylinder 5, a centerline radius of curvature which is substantially constant is also employed. This radius of curvature in the minor cross-sectional direction of the cylinder is dictated by the height of the chamber defined by the centerline element taken in the major cross-sectional dimension and by the location of the sides of the cylinder which points are to be intersected by the curvature of the cylinder head surface in the minor cross-sectional dimension. From these two loci of points defining the two centerlines of the surface in the cylinder head 3, the concave surface extends in a smooth continuous curve to a planar peripheral intersection coterminous with the planar top of the oblong cylinder. Naturally, intake, exhaust and spark plug ports extend through this surface.

Cooperating with the foregoing concave surface in the cylinder head 3 is a domed shape to the piston 6. The dome shape of the piston is preferably similarly configured to that of the concave surface with the centerline radii of curvature being greater such that a volume generally crescent shaped in cross section is created.

The configuration thus provided to the combustion chamber by the concave surface and the domed piston has a maximum thickness at the center of the chamber that tapers to each area of the chamber adjacent the periphery of the cylinder. This tapering volume is thus subjected to combustion chamber squish which results in movement of the mixture toward the center of the chamber as the piston approaches top dead center. In this way, a more advantageous charge mixture will be provided close to the spark plug 14.

Each pair of intake and exhaust valves is disposed in the direction of the major axis of the cross section of the cylinder bore 5, and their axes are symmetrically inclined in reference to the center axis C of the cylinder bore 5 outwardly in the direction of the major cross-sectional dimension of the oblong cylinder 5. In each assembly the axis I of the valve 12 and the axis E of the valve 13 are in the same plane with the axis C, the plane also containing the long axis of the cross section of the cylinder bore 5.

The valves 12 and 13 each include a valve stem and valve head with a symmetrical longitudinal axis extending through both the head and the stem. The heads of the valves 12 and 13 form as significant portion of the roof of the combustion chamber and thus help define the shape of that chamber in association with the concave surface of the cylinder head 3. The valves are arranged in such a manner that the longitudinal axes thereof are oriented normal to the concave surface of the cylinder head 3. In this way, the valve heads help to provide a somewhat continuous boundary to the combustion chamber. Thus, the angle of inclination of the valves is primarily determined by the curvature of the concave surface and the location of the valves in that surface.

The location of the valves in the concave surface of the cylinder head 3 can be of substantial importance in the present context because of the large relative size of the valves vis-a-vis the oblong shape of the cylinder itself. The size of each valve is generally restricted by the minor cross-sectional dimension of the cylinder 5. It is naturally preferred that the heads of the valves 12 and 13 not extend fully to the edge of the cylinder 5. Additionally, because the radius of curvature of each of the end portions of the cylinder are not much larger than the radius of curvature of the outer periphery of the head of each valve 12 and 13, fully 50% of the valve head is located adjacent to and quite near the wall of the cylinder 5. Because of this close fit between valve head and cylinder wall, flow from the intake port or to the exhaust port between either of the valves and the wall of the cylinder 5 may be restricted. Thus, there is a competing consideration between large valve heads for maximum port openings and interference between the large valve heads and the wall of the cylinder. To reduce the effect of the flow restriction between the valve head and the wall, the valve heads are positioned such that they are spaced from the ends of the oblong cylinder as much as practical. This results in a substantial decrease in the resistance to flow created by the wall through a large portion of the periphery of the valve head. Additionally, as the valve heads are inclined, the valve head periphery also extends away from the cylinder wall in an upward direction as it extends away from the end of the cylinder.

The two embodiments illustrated in the figures provide varying solutions to the competing interests of valve placement and spark plug placement. It is advantageous to locate the valves away from the ends of the oblong cylinder as mentioned just above. It is also advantageous to place the spark plug 14 centrally in the combustion chamber. In the embodiment of FIGS. 1–3, the spark plug 14 is placed in the center of the combustion chamber between the valves 12 and 13. Thus, the valves must be spaced somewhat toward the ends of the oblong cylinder.

Figure 4:
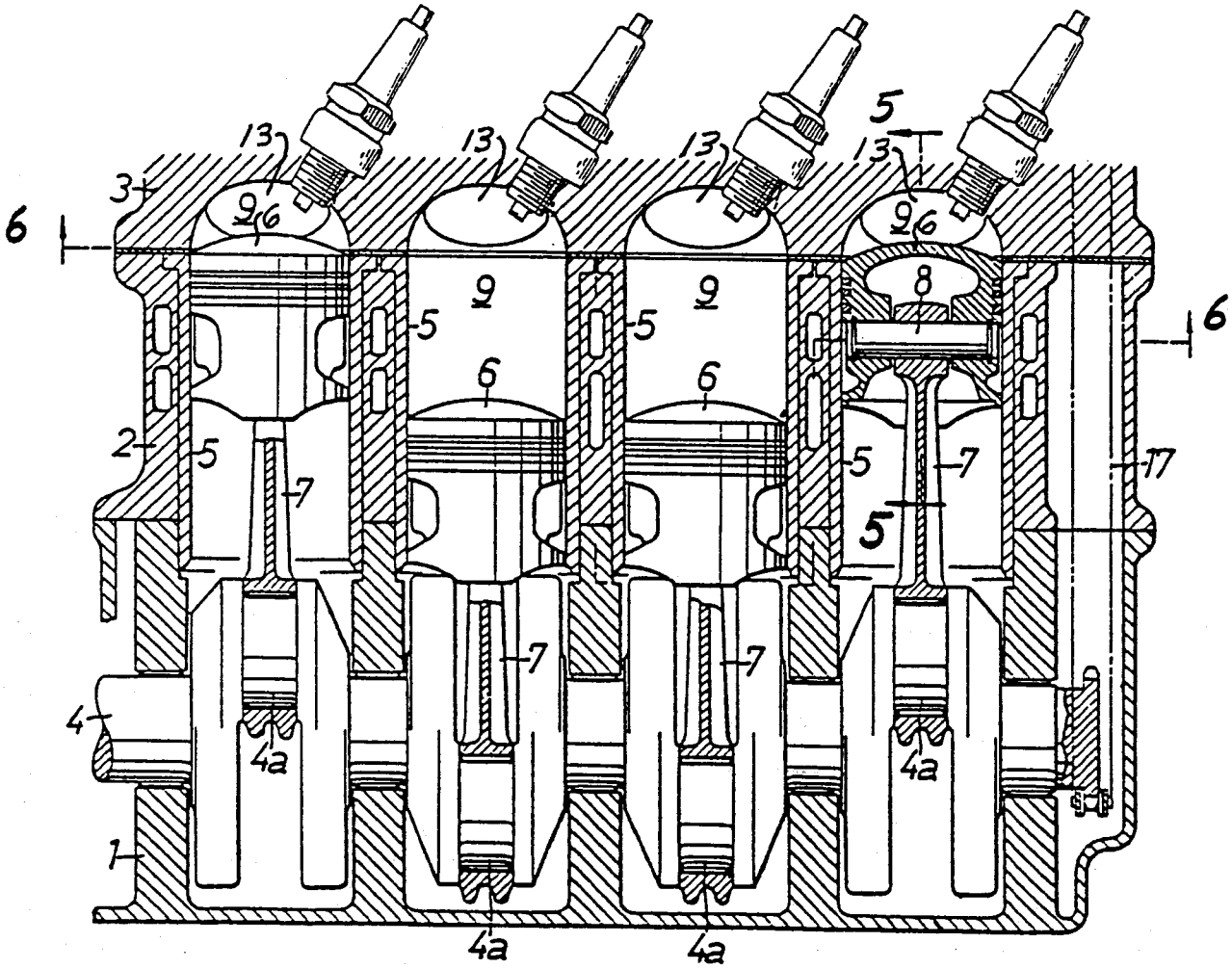
FIG. 4 is a longitudinal sectional view of a second preferred embodiment of this invention.
Figure 5:
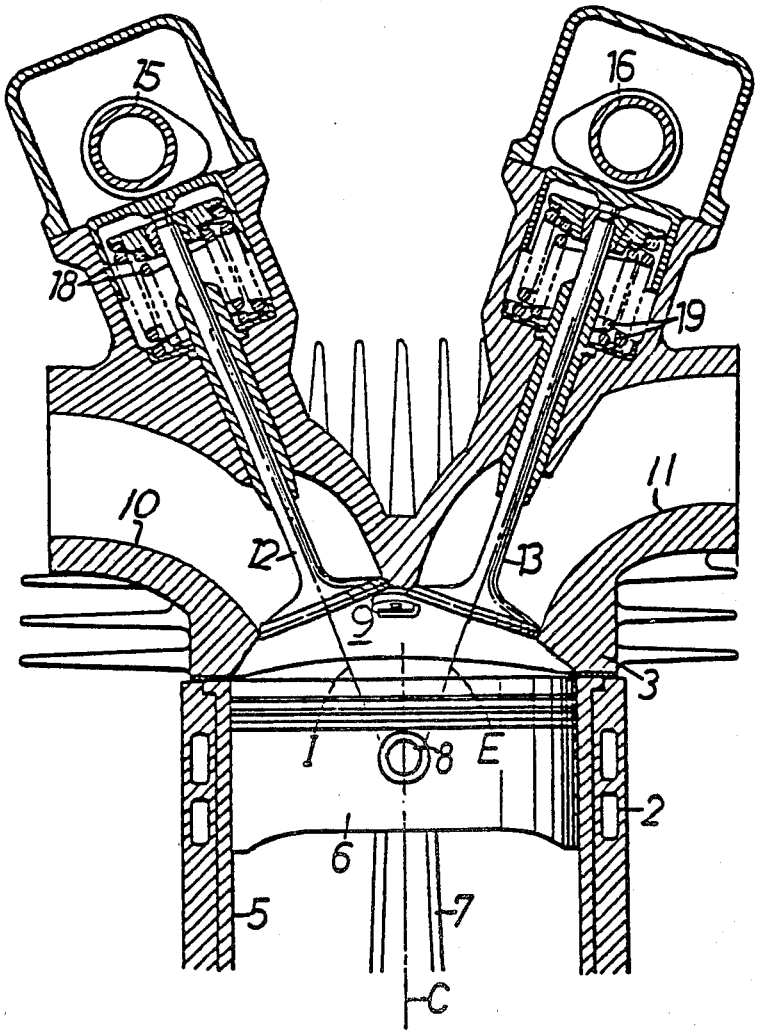
FIG. 5 is a transverse sectional view taken substantially on the lines 5—5 as shown on FIG. 4.
Figure 6:
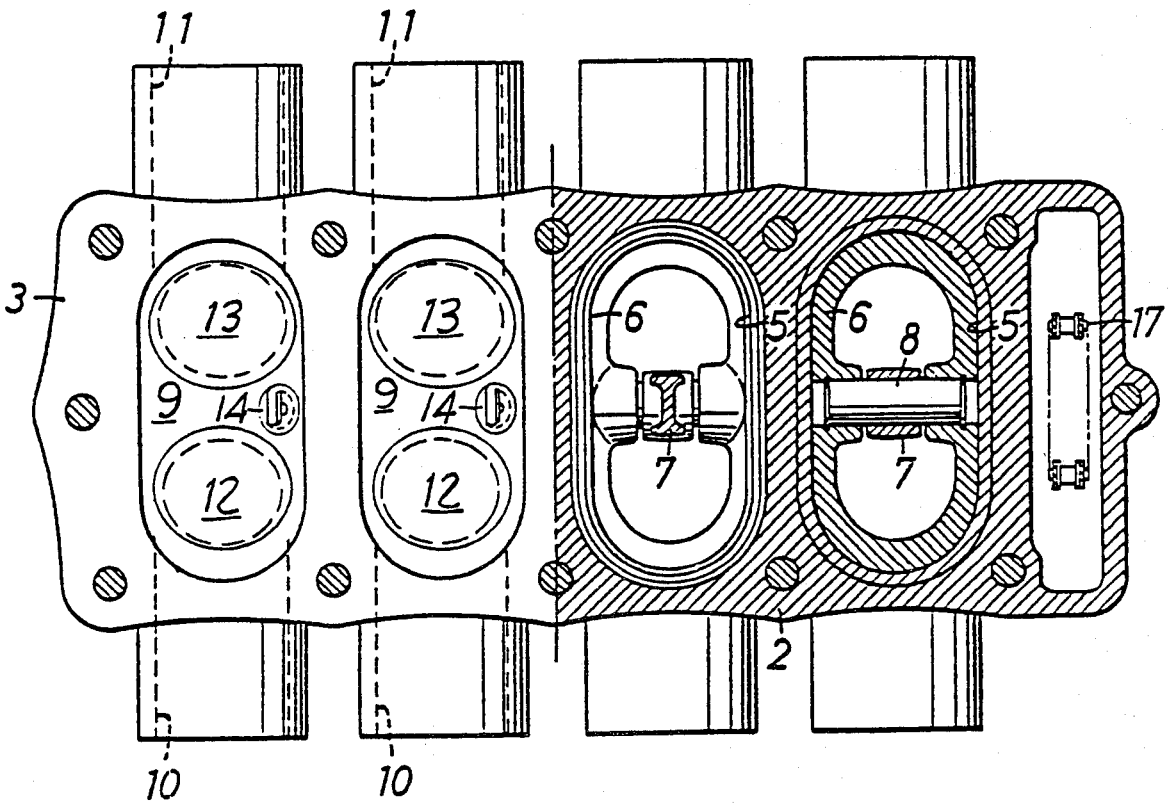
FIG. 6 is a plan view, partly in section taken substantially on the lines 6—6 as shown on FIG. 4.

In the second embodiment, illustrated in FIGS. 4–6 where the same numbers are employed for corresponding parts as used in the first embodiment, the spark plug 14 is displaced from the centerline extending along the major cross-sectional dimension of the cylinder. However, the spark plug 14 does remain on the centerline extending along the minor cross-sectional dimension of the cylinder.

The placement of the spark plug 14 at the location in the second embodiment, FIGS. 4–6, has been found to extend the maximum distance from the spark plug to the peripheral edge of the combustion chamber only a small amount. Consequently, the increase in performance resulting from a movement of the valves inwardly to reduce flow restriction is not offset by a decrease in performance resulting from an increase in the distance from the spark plug 14 to the furthest peripheral area of the combustion chamber.

An additional advantage associated with the movement of the spark plug to the off-center location is that the movement of the valves inwardly partially reduces the angle of inclination of the valves because the valves are now further around on the surface. Yet the valves remain normal to the surface. The combination of the reduced inclination and the physical movement of the valves inwardly toward the centerline reduces the overall width of the overhead cam mechanism illustrated in the embodiments.

This overhead cam arrangement includes an intake camshaft 15 for controlling operation of all of the intake valves 12, and an exhaust camshaft 16 for controlling operation of all of the exhaust valves 13. The camshafts 15 and 16 are parallel to the crankshaft 4 and are turned in timed relation by conventional means such as, for example, by a timing chain 17. The valve springs 18 and 19 move the intake and exhaust valves 12 and 13, respectively, in the closing direction.

It will be understood from the foregoing that, in accordance with this invention, the cross-sectional shape of the cylinder bore and piston are oblong rather than circular and may be described as generally elliptical or shaped as an elongated circle. A single poppet type intake valve and a single poppet type exhaust valve are positioned near the end portions of the oblong cylinder, and a spark plug is provided centrally along the shorter centerline. Although the spark plug is centrally located, the head of each valve can be placed where appropriate in the oblong cylinder bore. By this construction a larger size valve head for each valve can be employed, as compared to the cross-sectional area of the cylinder bore. Furthermore, the reduction of the intake and exhaust passageway resistance is substantial, enabling the charging efficiency of the mixture to be greatly improved.

Other advantages of the invention are that the output performance, fuel consumption and other features of operation of the engine are improved. The invention makes it possible to provide high performance four-cycle engines, and to provide economic savings by maintaining the simplest construction of one intake valve and one exhaust valve per cylinder.

When the invention is used with a multi-cylinder engine, the positioning of the plurality of cylinder bores in a direction at right angles to their long axes enables the overall length of the engine in the direction of the cylinder bore arrangement to be substantially reduced from that of a conventional engine having the same displacement and the same number of cylinders.

The symmetrical inclination of the axes of the valves for each cylinder with respect to the axis of that cylinder permits the use of larger diameter valves while maintaining a central position for the spark plug above the plane of the oblong outer boundary of the combustion chamber. The close proximity of the spark plug electrode gap promotes cleaning during the suction stroke, and moreover it insures that after the compression stroke the spark plug electrode gap is in contact primarily with unburned intake mixture.

Having fully described our invention, it is to be understood that we are not to be limited to the details herein set forth but that our invention is of the full scope of the appended claims.

What is claimed is:

1. An internal combustion engine comprising a cylinder, oblong in cross section;

a crankshaft mounted at a right angle to the major cross-sectional dimension of said oblong cylinder;

a cylinder head closing said oblong cylinder;

an intake poppet valve in said cylinder head adjacent one end of said oblong cylinder in communication with said oblong cylinder and having an intake valve head, an intake valve stem and a longitudinal axis through said intake valve head and said intake valve stem;

an exhaust poppet valve in said cylinder head adjacent the other end of said oblong cylinder in communication with said cylinder and having an exhaust valve head, an exhaust valve stem and a longitudinal axis through said exhaust valve head and said exhaust valve stem, said valve axes being symmetrically inclined outwardly in the direction of the major cross-sectional dimension of said oblong cylinder, said cylinder head including a concave surface with a first, centerline element thereof in the direction of the major cross-sectional dimension of said oblong cylinder having a constant radius of curvature substantially greater than one half the minor cross-sectional dimension of said oblong cylinder and a second, centerline element thereof in the direction of the minor cross-sectional dimension of said oblong cylinder having a constant radius of curvature greater than one-half the minor cross-sectional dimension of said oblong cylinder, said longitudinal axes of said valves being normal to said surface along said first centerline element; and a piston, oblong in cross section and mounted to slide in said cylinder, said piston having a convex domed piston head with third and fourth, centerline elements thereof in the direction of the major and minor cross-sectional dimensions of said oblong cylinder with each having a constant radius of curvature substantially greater than the radius of curvature of said first and second, centerline elements of said cylinder head surface, respectively.

2. The internal combustion engine of claim 1 further comprising a spark plug located between said valves on said first, centerline element.

3. The internal combustion engine of claim 1 further comprising a spark plug located in said concave surface along said third, centerline element thereof in the direction of the minor cross-sectional dimension of said cylinder and spaced from said first, centerline element.

4. The internal combustion engine of claim 1 further including at least two said cylinders, one said piston, one said intake poppet valve and one said exhaust poppet valve for each said cylinder, said cylinders being positioned in a bank of cylinders and identically oriented relative to said crankshaft.

5. An internal combustion engine comprising a cylinder, oblong in cross section, including in cross section two semicircular end wall segments and two planar side wall segments extending between said end wall segments;

a crankshaft mounted at a right angle to the major cross-sectional dimension of said oblong cylinder;

a cylinder head closing said oblong cylinder;

an intake poppet valve in said cylinder head adjacent one end of said oblong cylinder in communication with said oblong cylinder and having an intake valve head, an intake valve stem and a longitudinal axis through said intake valve head and said intake valve stem;

an exhaust poppet valve in said cylinder head adjacent the other end of said oblong cylinder in communication with said cylinder and having an exhaust valve head, an exhaust valve stem and a longitudinal axis through said exhaust valve head and said exhaust valve stem, said valve axes being symmetrically inclined outwardly in the direction of the major cross-sectional dimension of said oblong cylinder, said cylinder head including a concave surface with a first, centerline element thereof in the direction of the major cross-sectional dimension of said oblong cylinder having a constant radius of curvature substantially greater than one half the minor cross-sectional dimension of said oblong cylinder and a second, centerline element thereof in the direction of the minor cross-sectional dimension of said oblong cylinder having a constant radius of curvature greater than one-half the minor cross-sectional dimension of said oblong cylinder, said longitudinal axes of said valves being normal to said surface along said first centerline element; and a piston, oblong in cross section and mounted to slide in said cylinder, said piston having a convex domed piston head with third and fourth, centerline elements thereof in the direction of the major and minor cross-sectional dimensions of said oblong cylinder with each having a constant radius of curvature substantially greater than the radius of curvature of said first and second, centerline elements of said cylinder head surface, respectively.

6. An internal combustion engine comprising a cylinder, oblong in cross section;

a crankshaft mounted at a right angle to the major cross-sectional dimension of said oblong cylinder;

a cylinder head closing said oblong cylinder;

an intake poppet valve in said cylinder head adjacent one end of said oblong cylinder in communication with said oblong cylinder and having an intake valve head, an intake valve stem and a longitudinal axis through said intake valve head and said intake valve stem;

an exhaust poppet valve in said cylinder head adjacent the other end of said oblong cylinder in communication with said cylinder and having an exhaust valve head, an exhaust valve stem and a longitudinal axis through said exhaust valve head and said exhaust valve stem, said valve axes being symmetrically inclined outwardly in the direction of the major cross-sectional dimension of said oblong cylinder, said cylinder head including a concave surface with first and second, centerline elements thereof in the direction of the major and minor cross-sectional dimensions of said oblong cylinder, respectively, with each centerline element having a constant radius of curvature greater than one-half the minor cross-sectional dimension of said oblong cylinder, said concave surface extending from said first and second centerline elements to a planar peripheral boundary coterminous with the top of said oblong cylinder, said longitudinal axes of said valves being normal to said surface along said first centerline element; and a piston, oblong in cross section and mounted to slide in said cylinder, said piston having a convex domed piston head with third and fourth, centerline elements thereof in the direction of the major and minor cross-sectional dimensions of said oblong cylinder with each having a constant radius of curvature substantially greater than the radius of curvature of said first and second, centerline elements of said cylinder head surface, respectively.

7. An internal combustion engine comprising a cylinder, oblong in cross section;

a crankshaft mounted at a right angle to the major cross-sectional dimension of said oblong cylinder;

a cylinder head closing said oblong cylinder;

an intake poppet valve in said cylinder head adjacent one end of said oblong cylinder in communcation with said oblong cylinder and having an intake valve head, an intake valve stem and a longitudinal axis through said intake valve head and said intake valve stem;

an exhaust poppet valve in said cylinder head adjacent the other end of said oblong cylinder in communication with said cylinder and having an exhaust valve head, an exhaust valve stem and a longitudinal axis through said exhaust valve head and said exhaust valve stem, said valve axes being symmetrically inclined outwardly in the direction of the major cross-sectional dimension of said oblong cylinder, said cylinder head including a concave surface with a first, centerline element thereof in the direction of the major cross-sectional dimension of said oblong cylinder having a constant radius of curvature substantially greater than one half the minor cross-sectional dimension of said oblong cylinder and a second, centerline element thereof in the direction of the minor cross-sectional dimension of said oblong cylinder having a constant radius of curvature greater than one-half the minor cross-sectional dimension of said oblong cylinder, said longitudinal axes of said valves being normal to said surface along said first centerline element; and a piston, oblong in cross section and mounted to slide in said cylinder, said piston having a convex domed piston head with a third, centerline element thereof in the direction of the major cross-sectional dimension of said oblong cylinder having a constant radius of curvature substantially greater than the radius of curvature of said first, centerline element of said cylinder head surface, and a fourth, centerline element thereof in the direction of the minor cross-sectional dimension of said oblong cylinder having a constant radius of curvature substantially greater than the radius of curvature of said second, centerline element of said oblong cylinder head surface, said domed piston head extending from said third and fourth, centerline elements to a planar peripheral boundary.

8. An internal combustion engine comprising a cylinder, oblong in cross section;

a crankshaft mounted at a right angle to the major cross-sectional dimension of said oblong cylinder;

a cylinder head closing said oblong cylinder;

an intake poppet valve in said cylinder head adjacent one end of said oblong cylinder in communication with said oblong cylinder and having an intake valve head, an intake valve stem and a longitudinal axis through said intake valve head and said intake valve stem;

an exhaust poppet valve in said cylinder head adjacent the other end of said oblong cylinder in communication with said cylinder and having an exhaust valve head, an exhaust valve stem and a longitudinal axis through said exhaust valve head and said exhaust valve stem, said valve axes being symmetrically inclined outwardly in the direction of the major cross-sectional dimension of said oblong cylinder, said cylinder head including a concave surface with a first, centerline element thereof in the direction of the major cross-sectional dimension of said oblong cylinder having a constant radius of curvature substantially greater than one half the minor cross-sectional dimension of said oblong cylinder and a second, centerline element thereof in the direction of the minor cross-sectional dimension of said oblong cylinder having a constant radius of curvature greater than one-half the minor cross-sectional dimension of said oblong cylinder, said longitudinal axes of said valves being normal to said surface along said first centerline element, said valves being positioned in said cylinder head such that the center of each said valve head is displaced inwardly from the center of curvature of said end wall segments of said oblong cylinder; and a piston, oblong in cross section and mounted to slide in said cylinder, said piston having a convex domed piston head with third and fourth, centerline elements thereof in the direction of the major and minor cross-sectional dimensions of said oblong cylinder, with each having a constant radius of curvature substantially greater than the radius of curvature of said first and second, centerline elements of said cylinder head surface, respectively.

* * * * *